United States Patent [19]

Hagemeister

[11] Patent Number: 4,828,233

[45] Date of Patent: May 9, 1989

[54] BENT WIRE SPRING MODULE WITH LOCK

[75] Inventor: Robert C. Hagemeister, Boston, Mass.

[73] Assignee: Webster Spring Co. Inc., Oxford, Mass.

[21] Appl. No.: 271,370

[22] Filed: Nov. 14, 1988

Related U.S. Application Data

[63] Continuation of Ser. No. 80,005, Jul. 31, 1987, abandoned.

[51] Int. Cl.[4] ..... F16F 3/04; H47C 73/04

[52] U.S. Cl. ..... 267/103; 267/100; 5/259 R; 5/259 B; 5/248; 5/260

[58] Field of Search ..... 267/80, 91, 96, 100, 267/101, 103, 105, 110, 111, 112; 5/259 R, 259 B, 260, 267, 268, 270, 271

[56] References Cited

U.S. PATENT DOCUMENTS

| | | | |
|---|---|---|---|
| 1,462,990 | 7/1923 | Stadtler | 5/259 R |
| 2,172,302 | 9/1939 | Tinnerman | 5/259 B |
| 2,332,124 | 10/1943 | Young et al. | 5/260 |
| 3,084,353 | 4/1963 | le Vine | 5/270 X |
| 4,577,841 | 3/1986 | Hagemeister | 267/103 |
| 4,595,181 | 6/1986 | Hagemeister | 267/103 |

FOREIGN PATENT DOCUMENTS

| | | | |
|---|---|---|---|
| 0052637 | 2/1910 | Switzerland | 5/260 |

*Primary Examiner*—Andres Kashnikow
*Assistant Examiner*—Richard Potosnak
*Attorney, Agent, or Firm*—Robert T. Gammons

[57] ABSTRACT

A bent wire spring module embodying a clamp element at the upper end interengageable with the cross wire of a grid frame without requiring the formation of deviations in the cross wire to which it is attached.

2 Claims, 1 Drawing Sheet

BENT WIRE SPRING MODULE WITH LOCK

This is a continuation of copending application Ser. No. 080,005 filed on July 31, 1987, abandoned.

BACKGROUND OF THE INVENTION

In U.S. Pat. Nos. 3,662,411; 3,789,440; and 4,004,304, there are shown spring assemblies comprising a base frame and a grid frame between which are interposed and to which are connected coiled spring modules. The upper ends of the coiled spring modules are locked to the grid wires of the grid frame by interengagement or deviations in the upper ends of the coils with deviations in the grid wires. As thus structured, manufacture requires two separate operations, to wit, forming deviations in the grid wires and forming deviations in the upper ends of the coils. It is the purpose of this invention to provide means for locking the upper ends of the coils to the grid wires without the need for forming deviations in the grid wires as shown in the aforesaid patents.

SUMMARY OF THE INVENTION

As herein illustrated, the invention resides in forming the upper end of a spring module of the bent wire type for attaching to the grid wires of a grid frame without need for forming mutually interengageable deviations in the grid wires as disclosed in the aforesaid patents. More specifically, the invention resides in a bent wire spring module provided with means at its upper end for attachment to a grid wire of the grid frame and at its lower end with means for attachment to a cross bar of a base frame. In accordance with the invention, the grid wires of the grid frame are rectilinear throughout their length and the upper attaching means comprise longitudinally-spaced lengths of wire defining support members disposed below and transversely of the grid wires and longitudinally-spaced lengths of wire defining clamping members disposed above and transversely of the grid wire and inclined connecting lengths of wire connected at their opposite ends to, respectively, the support members and to the clamp members. The oppositely-inclined support member and clamp member embrace the grid wire above and below such as to capture the grid wire therebetween. The connecting length of wire is inclined with respect to the grid wire such that the lower end is connected to the support member and the upper end to the clamp member. Optionally, the connecting lengths of wire may be straight or curved. The longitudinally-spaced support members diverge with respect to the longitudinally-spaced clamp members. The longitudinally-spaced clamp members are disposed between the longitudinally-spaced support members and are connected to each other. Legs connect the support members to the crossbars of the base frame.

The invention will now be described in greater detail with reference to the accompanying drawings, wherein.

Figure 1:
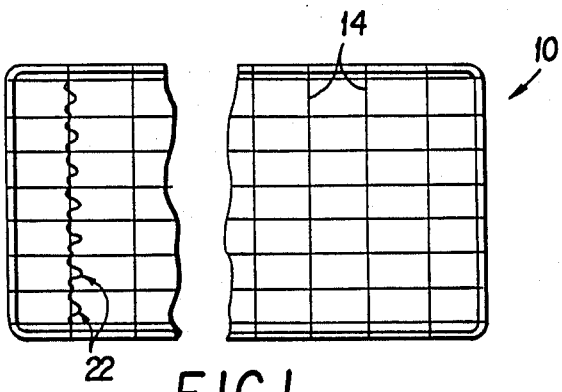
FIG. 1 is a plan view of a grid frame of rectangular configuration embodying longitudinally and transversely-extending crossing grid wires.
Figure 2:
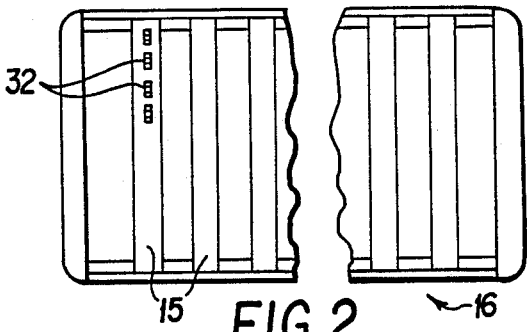
FIG. 2 is a plan view of a base frame embodying transversely-extending, longitudinally-spaced support bars.
Figure 3:
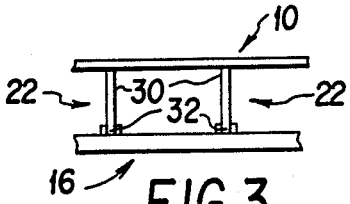
FIG. 3 is an elevation of one form of the spring module structured according to this invention.

Referring to FIG. 3, there is shown a grid frame 10 such as shown in FIG. 1 supported above a base frame 16 such as shown in FIG. 2 connected thereto by a plurality of transversely and longitudinally-spaced spring modules 22, FIG. 3, positioned therebetween with their upper ends attached to the wires 14 of the grid frame and their lower ends attached to the cross bars 15 of the base frame.

Figure 4:
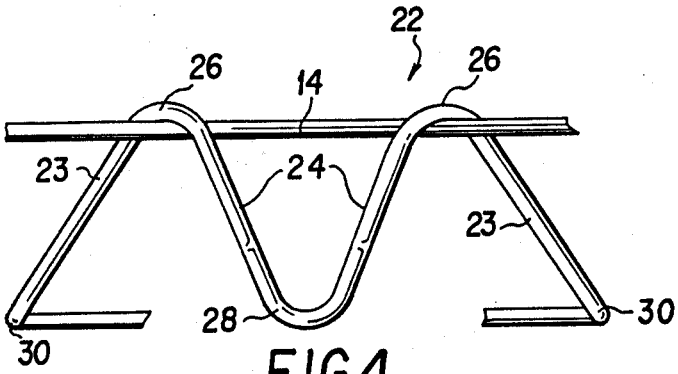
FIG. 4 is a plan view to larger scale of the upper end of the spring module in its preferred form engaged with a grid wire.
Figure 5:
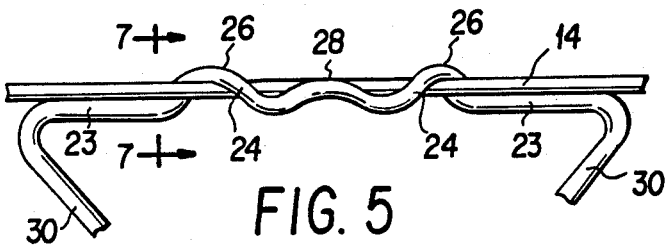
FIG. 5 is an elevation of the upper end of a spring module engaged with a grid wire.
Figure 6:
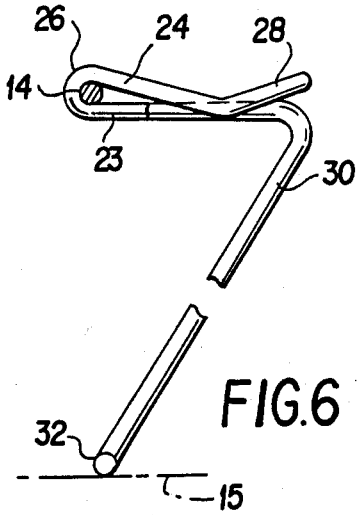
FIG. 6 is a view taken on the line 7—7 of FIG. 5.
Figure 7:
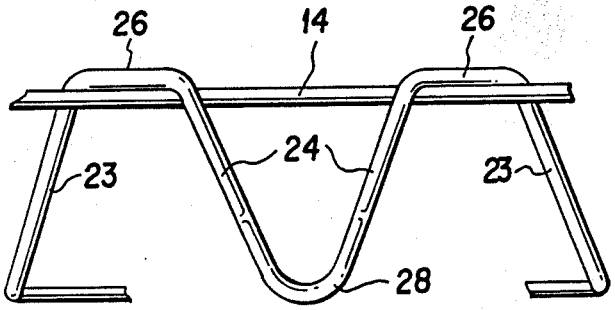
FIG. 7 is a plan view of the upper end of a spring module of alternative configuration.

In accordance with the invention, FIGS. 4, 5 and 6, the upper ends of the bent wire spring modules 22 are attached to the cross wires 14 of the grid frame without requiring deformation of the cross wires 14 as, for example, by forming deviations therein such as employed in the patents referred to above. For this purpose, as illustrated in FIGS. 4, 5, and 6, the upper end of each spring module 22 is formed to provide transversely-disposed supports 23—23, transversely-disposed locking elements 24—24 and transversely-disposed connecting elements 26—26. The supports 23—23 diverge and are inclined upwardly with respect to the axis of the grid wire 14, FIG. 7, the locking wires 24—24 converge and are inclined downwardly with respect to the grid wire 14, and the connecting wires 26—26 are inclined upwardly from the proximal ends of the support wires 23—23 and are connected at their lower ends to the support wires 23—23 and at their upper ends to the locking wires 24—24. The connecting wire 26—26 spirals about the grid wire 14 as shown in FIGS. 4, 5 and 6. However, the connecting wires 26—26 may be straight and inclined so that their lower ends are connected to the support wires and their upper ends to the locking wires 24—24, FIG. 7. Desirably, the distal ends of the locking wires 24—24 are connected by a curve of wire 28 which is inclined upwardly with respect to the locking wires 24—24. The distal ends of the support wires 23—23 have connected thereto the upper ends of legs 30—30 of suitable configuration for attachment to the cross bars 15 of the base frame.

As thus constructed, the oppositely inclined support wires 23—23 and clamping wires 24—24 grip the grid wire 14 sufficiently to inhibit free movement of the upper end of the module axially along the grid wire while providing a sufficiently firm grip on the grid wire that it is not necessary to provide deviations in the grid wire to prevent axial displacement of the upper end of the module to prevent relative movement between the upper end of the module and the grid wire.

As shown in FIG. 5, the legs 30—30 are connected at their upper ends to the support bars 23—23 and extend downwardly therefrom in converging relation to each other and have at their lower end oppositely-extending attaching elements 32—32 by means of which they can be attached to the bars 15 of the base frame 16.

The locking structure described is structured specifically for attaching the upper ends of bent wire spring modules to the crossing wires of the grid frame. However, corresponding structure may be formed at the upper ends of coil springs for attachment of the latter to the cross wires of the grid frame without the need for providing deviations in the wires of the grid frame.

It should be understood that the present disclosure is for the purpose of illustration only and includes all modifications or improvements which fall within the scope of the appended claims.

What is claimed is:

1. A spring assembly comprising an upper rectangular grid frame embodying spaced, parallel ends and transversely and longitudinally-extending, rectilinear, crossing grid wires connected at their ends to the sides and ends of the grid frame, a lower rectangular base frame embodying spaced, parallel sides, spaced, parallel ends and transversely-extending bars parallel to the ends, and bent wire spring modules disposed between the grid frame and base frame and attached at their upper ends to the grid wires of the grid frame and at their lower ends to the bars of the base frame, each bent wire spring module, being an integral body, comprising a pair of upstanding, rectilinear legs, diverging with respect to each other from their lower ends to their upper ends and means at the upper and lower ends of the legs for attachment to the wires of the grid frame and the bars of the base frame, said means at the upper ends of the legs connecting the upper ends of the legs to each other, comprising horizontal lengths of wire each connected at a first end to separate upper each of the legs, each of said horizontal lengths of wire extending transversely from its respective upper end of the legs at an acute angle to the leg, upwardly-inclined lengths of wire each having one end connected to a second end of the horizontal lengths of wire, extending therefrom at substantially right angles and inclined upwardly relative to the horizontal lengths of wire, downwardly-inclined converging lengths of wire connected at their upper ends to corresponding upper ends of the upwardly-inclined lengths of wire at an angle such that a plane containing said downwardly-inclined lengths of wire intersects a plane containing the horizontal lengths of wire and a curve of wire interconnecting converging ends of the downwardly-inclined lengths of wire is disposed in a plane inclined upwardly with respect to said plane containing the downwardly-inclined lengths of wire, said curve being inclined at an obtuse angle with respect to said plane containing the downwardly-inclined lengths of wire.

2. A spring assembly comprising an upper rectangular grid frame embodying spaced, parallel sides, spaced, parallel ends and transversely and longitudinally-extending, rectilinear grid wires connected at their ends to the sides and ends of the grid frame, a lower rectangular base frame embodying spaced, parallel sides, spaced, parallel ends and transversely-extending bars parallel to the ends and bent wire spring modules disposed between the grid frame and the bars of the base frame and attached at their upper ends to the grid frame and at their lower ends to the base frame, each spring module being an integral body, comprising a pair of converging, rectilinear legs disposed in a plane inclined to the grid frame and base frame and means at the upper and lower ends of the legs for attaching the legs to the grid frame and base frame, said means at the upper ends connecting the upper ends of the legs to each other, comprising horizontal, transversely-spaced, converging lengths of wire connected at a first end to the upper ends of the legs for underlying a grid wire, upwardly-inclined lengths of wire each having a lower end connected to second ends of the horizontal lengths of wire and disposed about said grid wire, said upwardly-inclined lengths of wire extending from said second ends of said horizontal lengths of wire toward each other, transversely-spaced, downwardly-inclined, converging lengths of wire situated between the horizontal lengths of wire and connected at their upper ends to corresponding upper ends of the upwardly-inclined lengths of wire in a plane inclined to a plane containing the horizontal lengths of wire such that said horizontal lengths of wire and said inclined lengths of wire embrace said grid wire, and a curve of wire interconnects the downward ends of the downwardly-inclined lengths of wire, said curve of wire being disposed in a plane inclined upwardly relative to the plane of the downwardly-inclined lengths of wire.

* * * * *